US007347190B1

(12) United States Patent
Keegan et al.

(10) Patent No.: US 7,347,190 B1
(45) Date of Patent: Mar. 25, 2008

(54) FUEL INJECTOR RAIL ASSEMBLY FOR DIRECT INJECTION OF FUEL

(75) Inventors: Kevin R. Keegan, Hilton, NY (US); Jared I. Meeker, Rochester, NY (US); Allan R. Wells, Rochester, NY (US); Kirk W. Caloroso, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/705,968

(22) Filed: Feb. 13, 2007

(51) Int. Cl.
*F02M 61/14* (2006.01)
*F02M 61/18* (2006.01)

(52) U.S. Cl. ..... 123/470; 123/456

(58) Field of Classification Search ..... 123/470, 123/456, 447, 468, 469
See application file for complete search history.

(56) References Cited

U.S. PATENT DOCUMENTS 5,022,372 A * 6/1991 Imura et al. ..... 123/469
6,354,273 B1 * 3/2002 Imura et al. ..... 123/467
6,470,859 B2 * 10/2002 Imura et al. ..... 123/467
7,159,569 B2 1/2007 Keegan et al.
2002/0053341 A1 * 5/2002 Imura et al. ..... 123/456
2005/0257774 A1 * 11/2005 Usui et al. ..... 123/456
2005/0279328 A1 * 12/2005 Zdroik ..... 123/470
2006/0180125 A1 * 8/2006 Kaishio ..... 123/456

* cited by examiner

*Primary Examiner*—Mahmoud Gimie
(74) *Attorney, Agent, or Firm*—Paul L. Marshall

(57) ABSTRACT

A fuel rail assembly includes a fuel injector socket having a cylindrical end for receiving an injector and a boxed end for orienting and positioning the injector relative to the engine cylinder. A boxed shape end cap is fitted over the boxed end of the socket thereby supporting the socket. Planar saddle members are disposed on each side of the end cap and radiused edges are fitted to the cylindrical surface of the fuel distribution tube. A jump tube communicates fuel from the fuel distribution tube to the fuel injector socket. A bracket defines a sole plate for the assembly, for attachment to an engine head, and includes a generally planar surface for locating against the planar surface of the saddle members. Components of the fuel rail assembly are first assembled loosely on a fixture, then joined together as the fuel rail assembly.

14 Claims, 6 Drawing Sheets

FUEL INJECTOR RAIL ASSEMBLY FOR DIRECT INJECTION OF FUEL

TECHNICAL FIELD

The present invention relates to fuel rail assemblies for supplying fuel to fuel injectors of internal combustion engines; more particularly, to fuel rail assemblies for supplying fuel for direct injection of gasoline (DIG) or diesel fuel (DID) into engine cylinders; and most particularly, to an improved injector socket and socket bracketry used in the assembly.

BACKGROUND OF THE INVENTION

Fuel rails for supplying fuel to fuel injectors of internal combustion engines are well known. A fuel rail assembly, also referred to herein simply as a fuel rail, is essentially an elongate fuel manifold connected at an inlet end to a fuel supply system and having a plurality of ports for mating in any of various arrangements with a plurality of fuel injectors to be supplied. Typically, a fuel rail assembly includes a plurality of fuel injector sockets in communication with a manifold supply tube, the injectors being inserted into the sockets and held in place in an engine head by bolts securing the fuel rail assembly to the head.

Gasoline fuel injection arrangements may be divided generally into multi-port fuel injection (MPFI), wherein fuel is injected into a runner of an air intake manifold ahead of a cylinder intake valve, and direct injection (DIG), wherein fuel is injected directly into an engine cylinder, typically during or at the end of the compression stroke of the piston. Diesel fuel injection is also a direct injection type.

For purposes of clarity and brevity, wherever DIG is used herein it should be taken to mean both DIG and DID, and fuel rail assemblies in accordance with the invention as described below are useful in both DIG and DID engines.

DIG fuel rails require high precision in the placement of the injector sockets in the supply tube because the spacing and orientation of the sockets along the fuel rail assembly must exactly match the three-dimensional spacing and orientation of the fuel injectors as installed in cylinder ports in the engine. Further, a DIG fuel rail must sustain much higher fuel pressures than a MPFI fuel rail to assure proper injection of fuel into a cylinder having a compressed charge. DIG fuel rails may be pressurized to 100 atmospheres or more, for example, whereas MPFI fuel rails must sustain pressures of only about 4 atmospheres. The DIG injector is mounted directly into the cylinder head. Thus, the precision positioning of the each injector socket relative to its mounting hardware and particularly its respective cylinder port, and the integrity of the weld and braze joints that serve to accurately position the socket along the fuel tube are critical to the performance of the fuel delivery system.

Efforts to form satisfactory DIG fuel rails by metal forming the sockets and welding them to the fuel tube have resulted in limited success. The fabricating processes can produce significant stresses in the formed parts, and even slight misalignments of components such as sockets mounted into the distribution tube can create even further stresses when the assembly is bolted to an engine head.

To address these issues, DIG fuel rails have been formed with integrated sockets by precision casting followed by boring of various passages, or by precision/high cost machining of stainless steel. However, prior art cast fuel rails suffer from at least three serious shortcomings. First, they are expensive to manufacture, requiring multiple steps in casting, boring, and finishing. Second, they are typically an aluminum alloy, which is known to be subject to attack by some fuels. Desirable resistant alloys such as stainless steel are more costly to cast. Third, because the integrated fuel rail and sockets have been formed as one piece, tolerances that may exist between the one piece assembly, the cylinder head and the cylinder itself can still cause misalignment of the injectors, after assembly. This can result in unacceptable stresses placed on the rail, sockets and the injectors.

These shortcomings of the integrated rail and sockets design have been addressed in U.S. Pat. No. 7,159,569 to Keegan et al. (hereinafter the '569 patent), issued on Jan. 9, 2007 and entitled FABRICATED FUEL RAIL ASSEMBLY FOR DIRECT INJECTION OF FUEL, of which relevant portions are hereby incorporated by reference. Disclosed therein is a fuel rail assembly wherein the rail and sockets are provided with saddle members and flanges and a jump tube fluidly connecting each socket to the fuel rail through a hole pierced in the side of the socket. The pieces are first loosely assembled in a jig to achieve a precise orientation and location for each of the sockets. Then, once the precise orientation and location is achieved, the sockets, jump tubes and rail are permanently jointed together as by welding or brazing. Thus, a precise positioning of the sockets relative to the cylinder itself can be attained in the X, Y and Z directions, independent of the tolerance stack up that heretofore has been found to exist. Also, the individual components can be fabricated less expensively as compared to the machined integrated tube/socket design. For example, the sockets may be deep drawn or formed from sheet steel instead of being cast and machined. However, this design suffers from a drawback in that the sockets are generally cylindrical making it difficult to fabricate a hole in the side of each socket to sealably receive a jump tube. Further, the saddle members and flanges that serve to precisely position the sockets must depend on the end flange of the socket as a locating reference point and cannot utilize the rounded portion of the cylindrical sockets to locate the positioning joints with the necessary accuracy.

What is needed in the art is a fuel rail assembly for DIG engine fuel systems, whose components can be fabricated inexpensively.

What is further needed in the art is a DIG fuel rail assembly that can precisely position each fuel injector socket relative to its respective cylinder independent of the tolerance stack-up of the combined components.

What is further needed in the art is a DIG fuel rail assembly wherein the jump tubes can be reliably positioned and sealed to the fuel injector sockets.

It is a principal object of the present invention to provide an inexpensive, high-precision fuel rail assembly for use with a DIG or DID internal combustion engine.

SUMMARY OF THE INVENTION

Briefly described, a fuel rail assembly, in accordance with the invention, includes a fuel injector socket having a cylindrical end for receiving a fuel injector and a boxed end for accurately orienting and positioning the injector relative to the engine cylinder. An end cap member, similarly boxed shape, is fitted over the boxed end of the socket supporting the socket on one or more sides. Planar saddle members are disposed on each side of the end cap member and include radiused edges for fitting to the outside contour of the cylindrical surface of the fuel distribution tube. A jump tube communicates fuel from the fuel distribution tube to the boxed shape end of the fuel injector socket. A bracket defines a sole plate for the assembly, for attachment to an engine head, and a generally planar surface for locating against the planar surface of one of the saddle members. Preferably, all components are formed of a non-reactive, brazable alloy such as stainless steel, for example, 304 stainless steel.

Components of a fuel rail assembly in accordance with the invention may be first assembled loosely on a precision fixture, then joined to fix relationships and brazed and fired in a brazing oven to produce a precision, fuel rail assembly.

The fuel injector socket, including its cylindrical portion and its boxed end portion, may be formed as one piece from sheet steel or its boxed end portion and cylindrical portion may be formed separately and joined together. The bracket and one saddle may also be formed in one piece. On one aspect of the invention, the planar surface of the saddle members may be located directly against the boxed end surfaces of the fuel injector socket. Thereby eliminating the end cap member.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
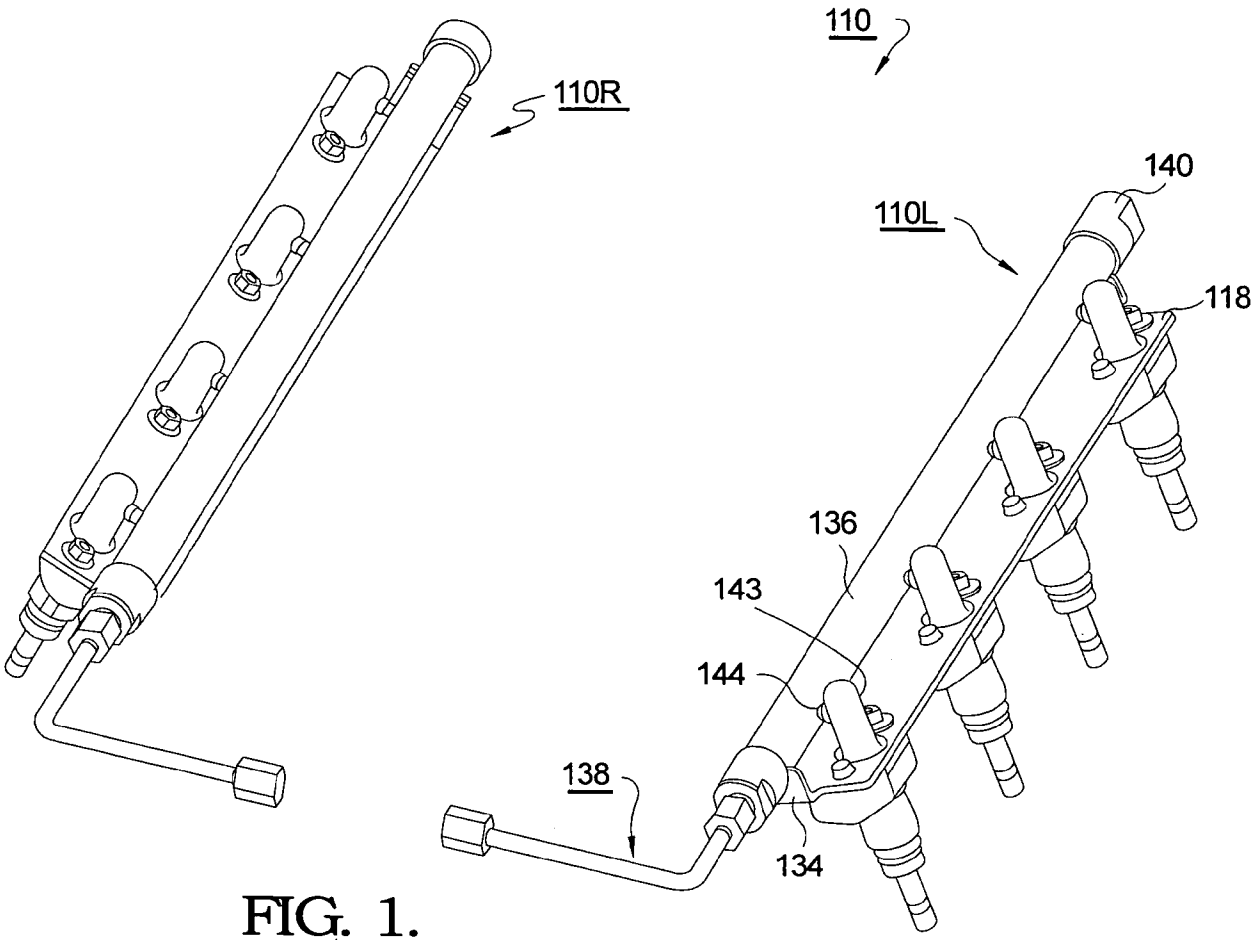
FIG. 1. (PRIOR ART)
FIG. 1 is an isometric view of a first prior art embodiment of a DIG fuel rail assembly for the left and right heads of a V-8 engine.

Referring to FIG. 1, prior art fuel rail assemblies 110, as generally disclosed in the '569 patent, are shown exemplarily arranged as for use on a V-8 engine 112 (left assembly 110L, right assembly 110R). For simplicity, the following description of the prior art assembly deals solely with left assembly 110L (referred to herein below as "110") but should be taken as applying equally to right assembly 11 OR.

Figure 2:
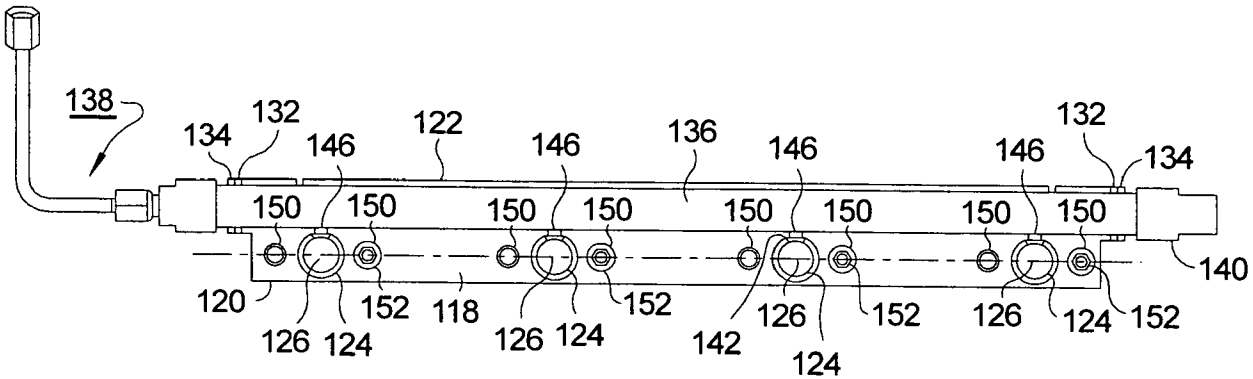
FIG. 2. (PRIOR ART)
FIG. 2 is a plan view of the left prior art fuel rail assembly shown in FIG. 1.
Figure 3:
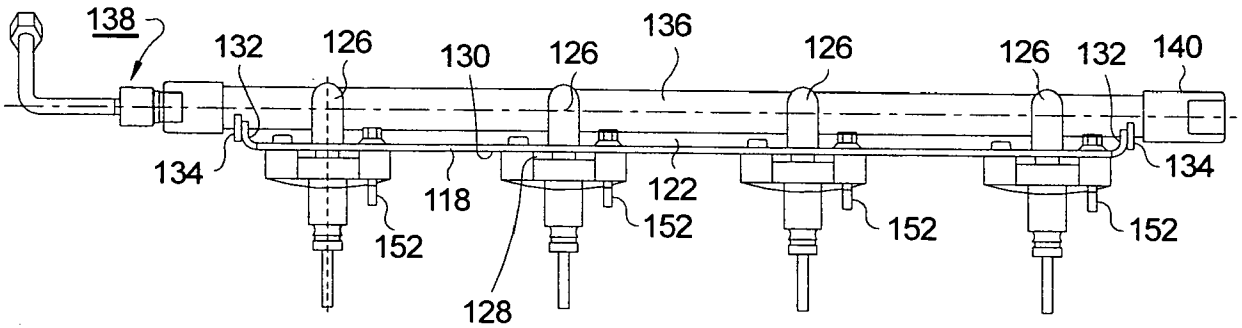
FIG. 3. (PRIOR ART)
FIG. 3 is an elevational view of the left prior art fuel rail assembly shown in FIG. 1.

Referring to FIGS. 1 through 3, fuel rail assembly 110 comprises a metal bracket 118 having a foot portion 120, defining a sole plate for mating with an engine head via bolts 152 through bracket bolt holes 150, and a flange portion 122 (FIG. 2) formed generally orthogonal to foot portion 120 for structural rigidity. Foot portion 120 is provided with a plurality of openings 124 for receiving a plurality of formed sockets 126, each having a flange 128 at the open end of the socket for mating with the underside surface 130 of portion 120. Openings 124 are oversize to allow lateral positioning adjustment of sockets 126 during assembly of the fuel rail. Bracket 118 further comprises a flange 132 at each end for supporting a saddle 134. Supported by saddles 134 is a fuel distribution tube 136. Fuel supply tube and fittings 138 at a first end and a cap 140 at a second end of fuel distribution tube 136 are shown, a known in the art. Each socket 126 is provided with an opening 142 through a side of rounded cylindrical portion 143, and distribution tube is provided with a plurality of matching openings 144, wherein jump tubes 146 are received for supplying fuel from tube 136 to each socket 126.

Note that it is an important feature of the fuel rail assembly disclosed in the '569 patent that the assembly fit precisely onto an engine head wherein the fuel injectors have been inserted and are extending from their respective precision bores. Accordingly, the components of the fuel rail are first assembled loosely onto a fixture simulating such an engine head, to assure proper orientations and positions of the components in the X, Y and Z directions, then are secured to each other to prohibit further relative movement.

Figure 4:
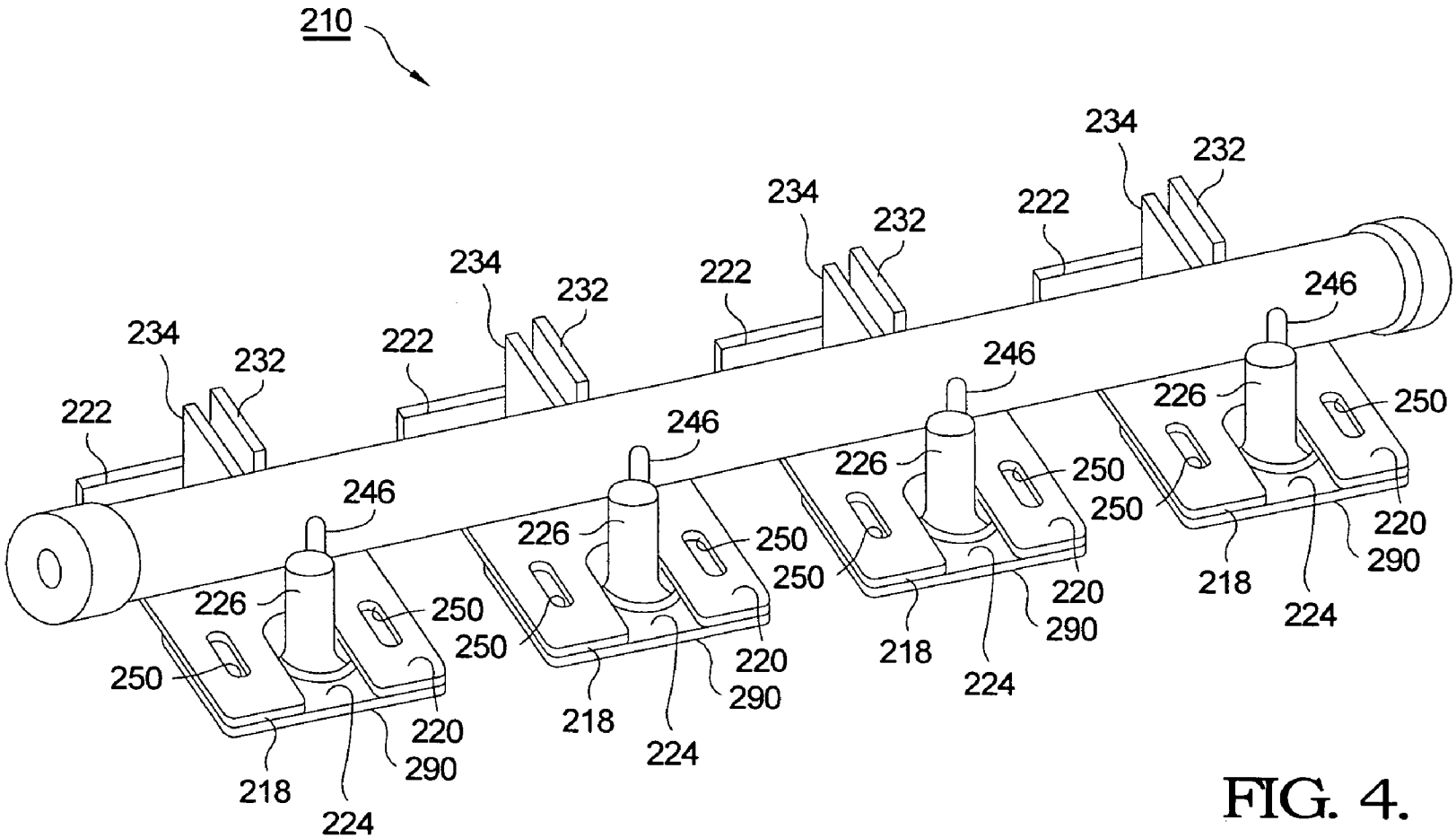
FIG. 4. (PRIOR ART)
FIG. 4 is an isometric view of a second prior art embodiment of a fuel rail assembly.

Referring now to FIG. 4, a second embodiment 210 of a fuel rail assembly of the prior art, as disclosed in the '569 patent, is similar to first embodiment 110 except that single bracket 118 is replaced by a plurality of individual brackets 218, one for each fuel injector position. Each bracket 218 comprises a sole plate 220 and a generally orthogonal first flange 222 for structural rigidity. A second flange 232 on bracket 218 is supportive of a saddle 234, one for each bracket 218. Saddles 234 are supportive of fuel distribution tube 236. Brackets 218 are provided with oversize slotted openings 224 for receiving sockets 226 which are retained by retaining plates 290. Jump tubes 246 are connected between distribution tube 236 and sockets 226. Brackets 218 are provided with elongated bolt holes 250 for bolting assembly 210 to an engine head.

Figure 5:
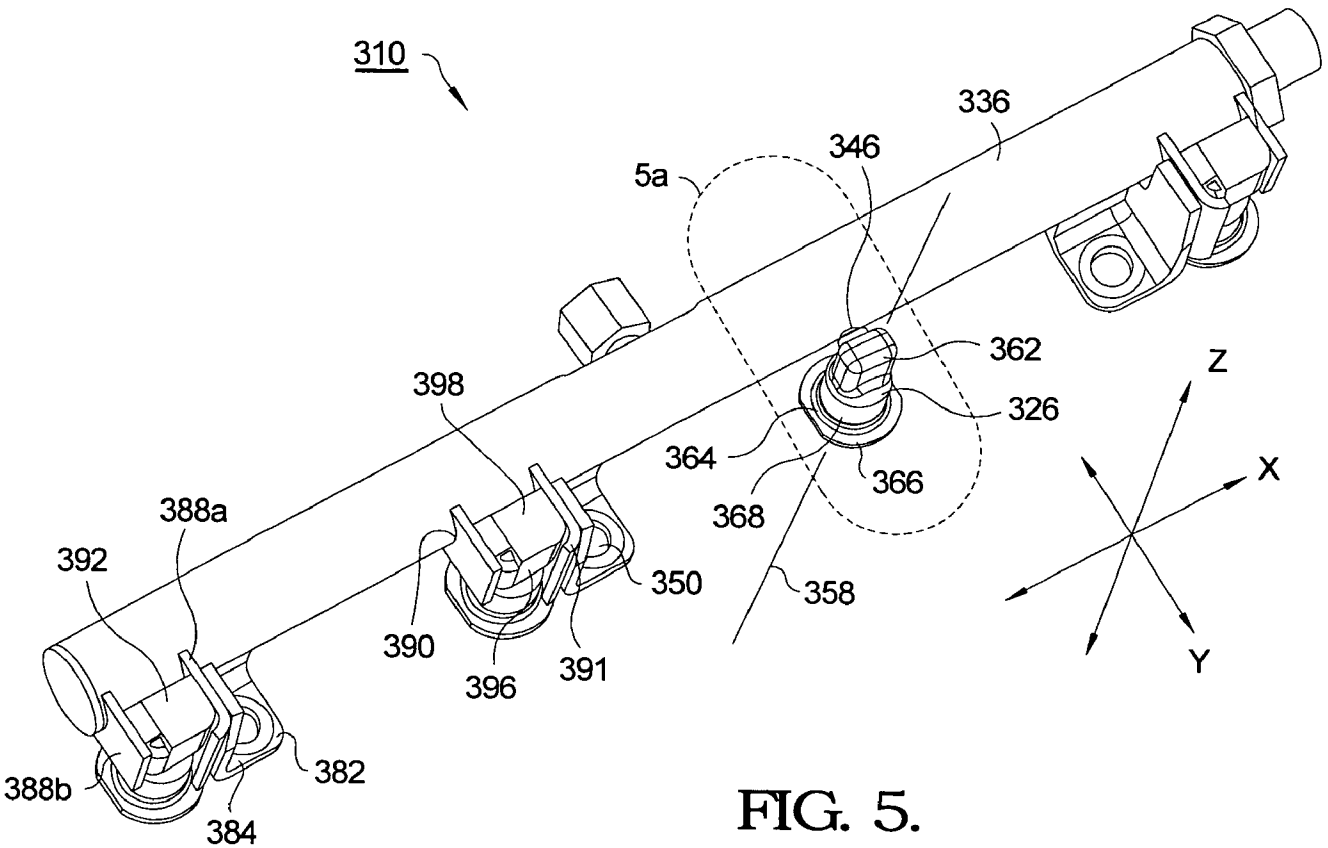
FIG. 5 is an isometric view of a DIG fuel rail assembly, in accordance with the invention, for one bank of a V8 engine with the bracketry around one of the injector sockets removed.
Figure 5A:
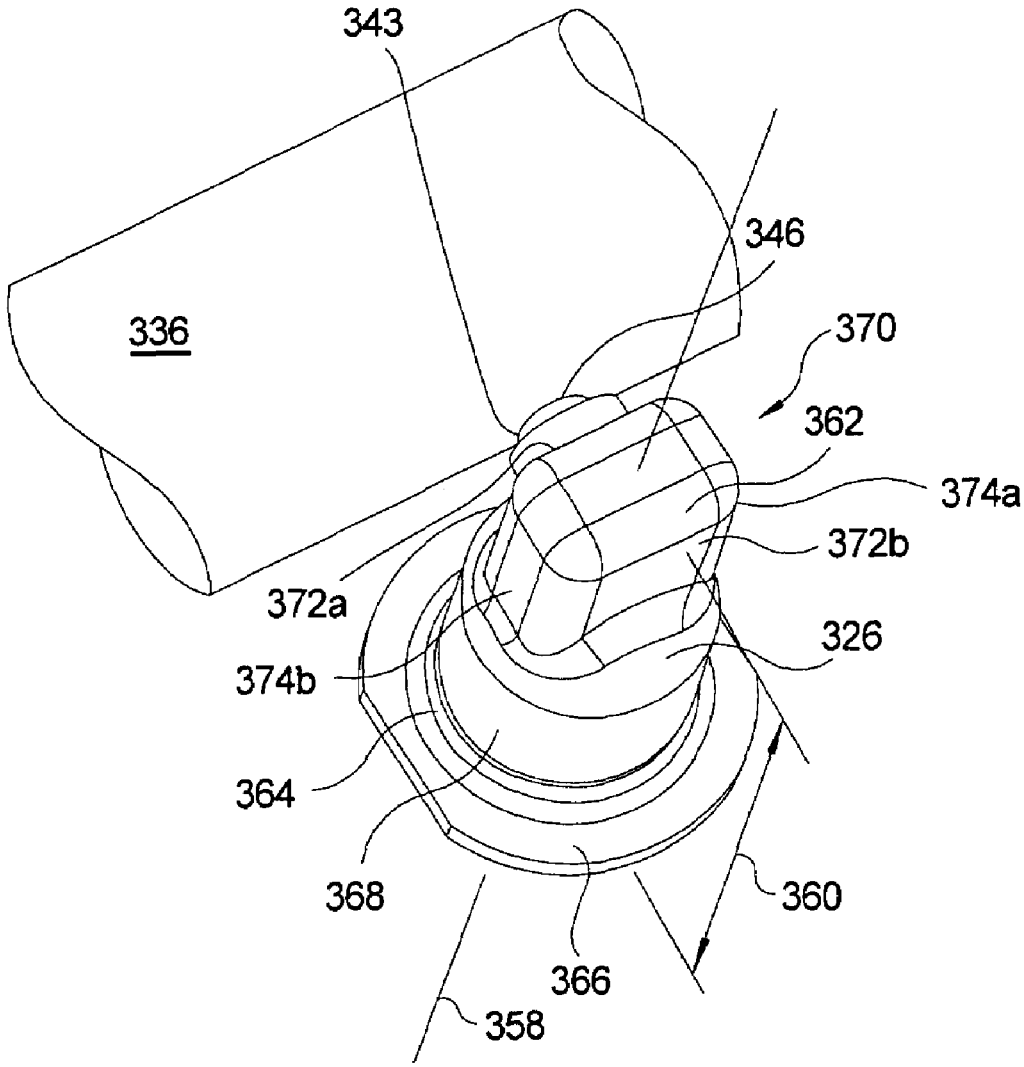
FIG. 5*a* is a closeup view of the socket, jump tube and distribution tube shown in FIG. 5 in box 5*a;*
Figure 6:
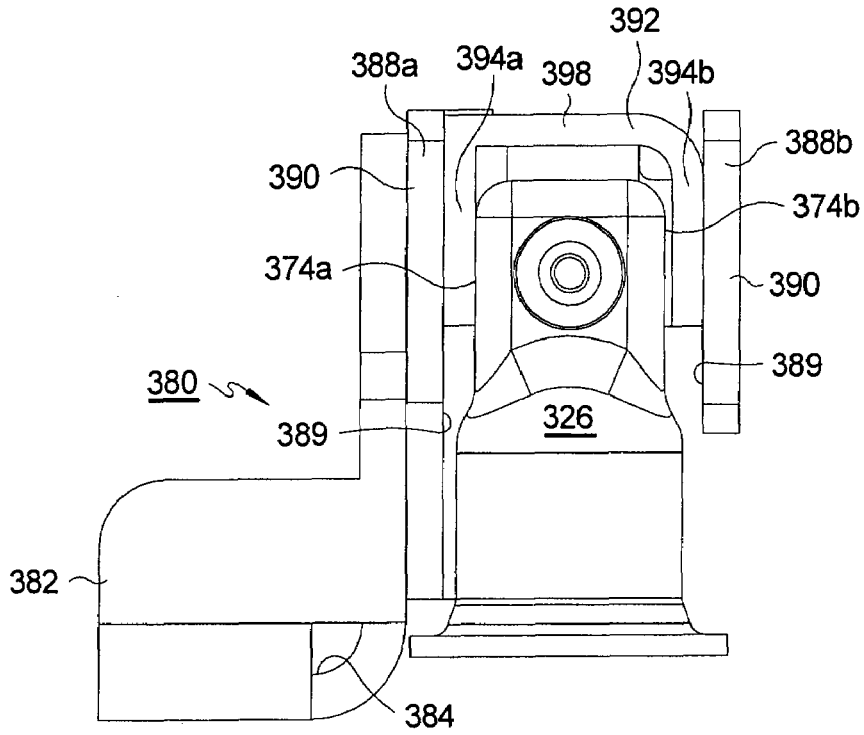
FIG. 6 is an elevational cross-sectional view of one of the assembled sockets as viewed along arrow 6 in FIG. 5, in accordance with the invention.
Figure 7:
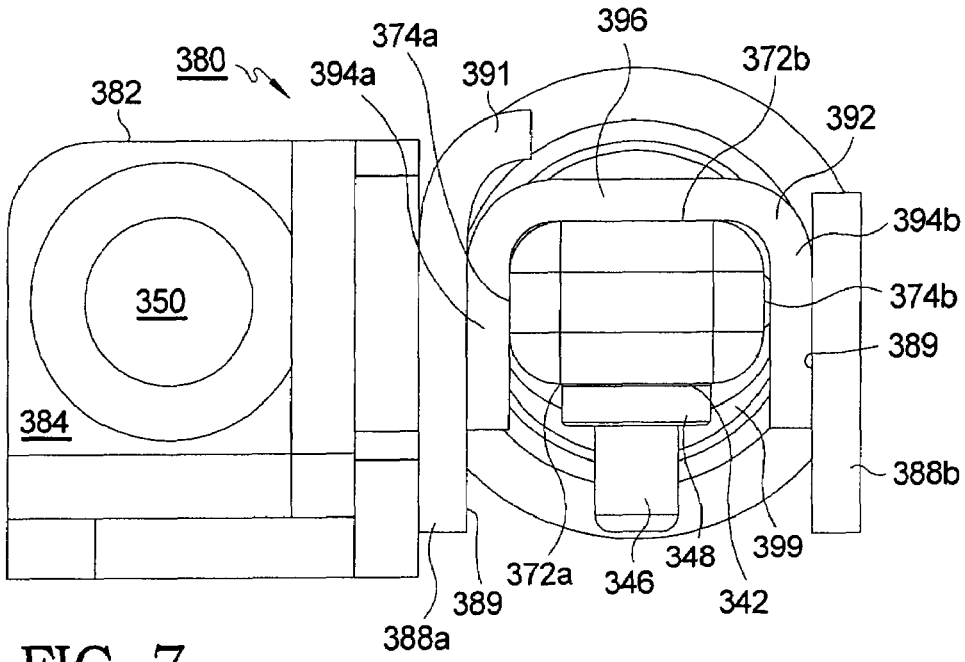
FIG. 7 is a top view of one of the assembled sockets in accordance with the invention, with the fuel distribution tube and the top surface of the socket end cap removed.

Referring to FIGS. 5, 6 and 7, fuel rail assembly 310 in accordance with the invention is shown. Fuel rail assembly 310 includes, as its main components, fuel distribution tube 336, jump tube 346, fuel injector sockets 326, and various saddles and flanges to assure precise orientation and positioning of the sockets. Referring to FIG. 5 in which the surrounding components of the third from left injector socket have been left out for clarity of description, and FIG. 5*a*, socket 326 includes central axis 358 and elongate body portion 360, generally cup-shaped and closed at a first end 362. Second end 364 is open and defines flange 366. Elongate body portion includes cylindrical section 368 adjacent flange 366 for sealably receiving an end of a fuel injector assembly (not shown) as known in the art. Cylindrical section 368 and flange 366 are similar to the open end of injector sockets known in the art.

In accordance with the invention, elongate body portion 360 of socket 326 also defines boxed section 370. The boxed section includes first planar opposing sides 372*a,b* and seconded planar opposing sides 374*a,b*. Sides 372*a,b* and 374*a,b* are formed in planes generally parallel to socket central axis 358. In one aspect of the invention, one of said first and second set of planar opposing sides is longer than the other, such as sides 372*a,b* are longer than sides 374*a,b* as shown in FIG. 7. Boxed section 370 is closed at first end 362, opposite flange 366, thereby forming a generally cup shaped fuel injector socket as known in the art, the primary difference being boxed section 370. Socket 326 may be readily formed or drawn from sheet steel. An opening 342 is formed in one of the sides 372*a*, 372*b*, 374*a*, 374*b* to receive jump tube 346 during assembly of fuel rail assembly 310. In one aspect of the invention, opening 342 is formed in one of the longer sides 372*a* for receiving jump tube 346 to add rigidity to the longer planar side for opposing the high pressures of the DIG system. Jump tube 346 may include collar 348. A corresponding opening 343 is formed in fuel distribution tube for receiving the other end of jump tube 346.

Referring again to FIGS. 5, 6 and 7, mounting assembly 380 is shown for precisely orienting and locating the sockets relative to their respective cylinders in accordance with the invention. Mounting assembly 380 includes, for each fuel injector socket, a mounting bracket 382, a first saddle 388*a*, a second saddle 388*b* and a socket end cap 392. Each bracket 382 comprises a base plate 384 and a generally orthogonal first flange 386. Base plate 384 is provided with a hole 350 for mounting the bracket and the rail assembly to the cylinder head (not shown) with a bolt (not shown). First saddle 388*a* adjacent bracket 382 includes a generally planar surface 389 and further includes a radiused edge 390 supportive of fuel distribution tube 336 and shaped to closely fit the outer circumferential contour of fuel distribution tube 336. First saddle 388*a* may also include first saddle flange 391 generally orthogonal to planar surface 389 for structural rigidity. Socket end cap 392, disposed adjacent first saddle 388*a*, is generally box-shaped including opposing planar sides 394*a* and 394*b* disposed in planes parallel to each other, third side 396 and top 398. Side 399 is open to permit passage of jump tube 346 from fuel distribution tube 336 to fuel injector socket 326. The box-shape of socket end cap 392 is sized to freely receive boxed section 370 of fuel injector socket 326. Second saddle 388*b*, adjacent end cap 392, is generally planar and, similar to first saddle 388*a*, includes planar surface 389 and a radiused edge 390 supportive of fuel distribution tube 336 and shaped to closely fit the outer circumferential contour of fuel distribution tube 336.

To assure accurate positioning of the fuel injector socket, fuel rail assembly 310 may be sub-assembled in an assembly fixture having mandrels simulating fuel injectors in an engine and a first reference feature simulating the mounting points of brackets 382 to the cylinder head, and a second reference feature correctly positioning fuel distribution tube 336, axially, relative to the cylinder head. In this manner, the fuel injector sockets have freedom of movement in the X, Y and Z directions (FIG. 5) to be first precisely located and oriented before being fixed in place by welding and brazing.

An exemplary method of assembling fuel rail assembly, in accordance with the invention, comprises the steps of:

a) installing a socket 326 onto each mandrel to a predetermined axial and rotational position;

b) inserting a first end of a jump tube 346 into each socket opening 342 of side 372*a* of the socket;

c) positioning a fuel distribution tube against the second reference feature of the fixture while at the same time inserting a second end of each jump tube 346 into receiving holes 343 formed in the fuel distribution tube;

d) fitting socket end cap 392 over boxed section 370 of first end 360 of the fuel injector socket so that planar opposing side 374*a* of section 370 is proximate opposing side 394*a* of the socket end cap, planar opposing side 374*b* of section 370 is proximate opposing side 394*b* of the socket end cap, and planar side 374*b* of section 370 is proximate third side 396 of the socket end cap;

e) engaging radiused edges 390 of saddles 388*a,b* with the circumferential outer surface of the fuel distribution tube 336 and the planar surfaces 389 of saddles 388*a,b* with sides 394*a* and 394*b* so that planar surfaces lie flat against sides 394*a,b* and generally perpendicular to the longitudinal axis of the fuel distribution tube;

f) locating a mounting bracket against the first reference in the assembly fixture and such that first flange 386 of the bracket is flatly in contact with saddle 388*a;* g) joining, as for example by tack welding, all components together;

h) applying a braze filler metal to all joints and seams to form a "green" fuel rail assembly; and i) heating the green assembly, as in a brazing oven to seal and/or loin with braze all joints and seams.

As compared to the prior art, fuel rail assembly 310, in accordance with the invention, beneficially provides flat mating surfaces between bracket 382 and saddle 388*a*, between saddle 388*a* and socket end cap 392, and between socket end cap 392 and saddle 388*b* for improved weld/brazed joints and for more accurately orienting and positioning the fuel injector sockets within the assembly. Further, the close fit of socket end cap 392 over the top and three sides of boxed end section 370 of the fuel injector socket provides support to the planar walls of the socket under the higher fuel pressures of the DIG system. Rigidity is added to the fourth wall by the jump tube.

While the entire elongate body 360 of socket 326, including boxed section 370 and the lower tubular cylindrical section of the body is shown as formed as one piece, it is understood that the lower section and boxed section may be formed separately and then joined and sealed together, and that the boxed section may then be machined instead of drawn from sheet stock.

While the first saddle and bracket are shown as separate components, it is understood the two could be formed as one piece, in accordance with the invention.

While a box-shaped socket end cap is shown fitting between the boxed section of the fuel injector socket and the first planar saddle to add structure rigidity to the boxed section of the socket, it is understood that the socket end cap may be eliminated and the first planar saddle be disposed directly against one of the planar sides of the boxed section of the fuel injector socket.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A fuel rail assembly for supplying fuel to a fuel injector of an internal combustion engine, comprising:

a) a bracket defining a sole plate for said assembly and including a feature corresponding to the location of said fuel injector in said engine, and a first planar member;

b) a fuel distribution tube for providing fuel under pressure to fuel injector from a fuel pressurizing source;

c) a first saddle extending from said bracket for supporting said fuel distribution tube and defining a second planar member;

d) a fuel injector socket end cap defining a third planar member, said third planar member disposed adjacent said second planar member;

e) a fuel injector socket having a first open end for receiving an inlet end of said fuel injector, a second end of said socket defining a first flat surface for engagement with said third planar member; and f) a jump tube extending between said fuel distribution tube and said socket for providing fuel from said fuel distribution tube to said fuel injector.

2. A fuel rail assembly in accordance with claim 1 wherein said socket includes a second flat surface for receiving an end of said jump tube.

3. A fuel rail assembly in accordance with claim 1 further including a second saddle for supporting said fuel distribution tube and defining a fourth planar member, and said fuel injector socket end cap socket defining a fifth planar member, said fourth planar member disposed adjacent said fifth planar member.

4. A fuel rail assembly in accordance with claim 3 wherein said socket includes a second flat surface disposed adjacent said fifth planar member.

5. A fuel rail assembly in accordance with claim 1 wherein said bracket and said first saddle are formed in one piece.

6. A fuel rail assembly in accordance with claim 1 formed by assembly and welding together of said bracket, said socket, said saddle, said end cap, and said jump tube on a precision fixture.

7. A fuel rail assembly in accordance with claim 6 wherein said precision fixture is representative of an engine head having the inlet end of a fuel injector extending therefrom.

8. A fuel rail assembly for supplying fuel to a fuel injector of an internal combustion engine, comprising:

a) a bracket defining a sole plate for said assembly and including a feature corresponding to the location of said fuel injector in said engine, and a first planar member;

b) a fuel distribution tube for providing fuel under pressure to fuel injector from a fuel pressurizing source;

c) a first saddle extending from said bracket for supporting said fuel distribution tube and defining a second planar member;

d) a fuel injector socket having a first open end for receiving an inlet end of said fuel injector, a second end of said socket defining a first flat surface for engagement with said second planar member; and e) a jump tube extending between said fuel distribution tube and said socket for providing fuel from said fuel distribution tube to said fuel injector.

9. A fuel rail assembly in accordance with claim 8 wherein said socket includes a second flat surface for receiving an end of said jump tube.

10. A fuel rail assembly in accordance with claim 8 further including a second saddle for supporting said fuel distribution tube and defining a third planar member and said socket defining a second flat surface adjacent said third planar member.

11. A fuel rail assembly in accordance with claim 8 wherein said bracket and said first saddle are formed in one piece.

12. A fuel injector socket for supplying fuel from a fuel distribution tube to a fuel injector of an internal combustion engine, comprising a first open end for receiving an inlet end of a fuel injector, a second closed end, and an elongate body connecting said first open end and said second closed end, wherein said elongate body includes a first flat surface generally parallel to a central axis of said socket and an opening therein.

13. A fuel injector socket in accordance with claim 12 wherein said elongate body further includes a second flat surface parallel to said first flat surface.

14. A fuel injector socket in accordance with claim 13 wherein said elongate body further includes third and fourth flat surfaces in planes parallel to each other and parallel to said central axis of said socket.

* * * * *